US006347405B1

(12) United States Patent
Boyko

(10) Patent No.: US 6,347,405 B1
(45) Date of Patent: Feb. 19, 2002

(54) METHOD OF PROTECTING GARMENTS FROM SOILING AND WEAR

(76) Inventor: Patricia Boyko, 415 Kerr Place, Saskatoon, Saskatchewan (CA), S7N 3R4

( * ) Notice: Subject to any disclaimer, the term of this patent is extended or adjusted under 35 U.S.C. 154(b) by 0 days.

(21) Appl. No.: 09/779,161

(22) Filed: Feb. 8, 2001

(51) Int. Cl.[7] ..... A41D 27/12
(52) U.S. Cl. ..... 2/62
(58) Field of Search ..... 2/62, 24, 53, 54, 2/231

(56) References Cited

U.S. PATENT DOCUMENTS 514,576 A * 2/1894 Walther et al.
1,147,404 A * 7/1915 Johnson
1,440,121 A * 12/1922 Abrahamson
1,654,452 A * 12/1927 Bradley
2,431,287 A * 11/1947 Washington
2,568,083 A * 9/1951 Mitchell ..... 2/231
4,805,239 A * 2/1989 Ciago ..... 2/24
4,879,765 A * 11/1989 Bailie et al. ..... 2/24
5,103,500 A * 4/1992 Nager et al. ..... 2/56
5,884,330 A * 3/1999 Erlich ..... 2/53
5,896,580 A * 4/1999 Aldrich et al. ..... 2/24
5,920,902 A * 7/1999 Crampton ..... 2/24
6,029,273 A * 2/2000 McCrane ..... 2/24
6,178,557 B1 * 1/2001 Bel Monte ..... 2/60

* cited by examiner

*Primary Examiner*—John J. Calvert
*Assistant Examiner*—Alissa L. Hoey
(74) *Attorney, Agent, or Firm*—Stites & Harbison, PLLC; David W. Nagle, Jr.

(57) ABSTRACT

A method of protecting a garment area from soiling and wear comprises adhesively attaching a flexible first adhesive patch to a desired garment area; removing and discarding the first adhesive patch and attaching a flexible second adhesive patch to substantially the same garment area.

10 Claims, 1 Drawing Sheet

METHOD OF PROTECTING GARMENTS FROM SOILING AND WEAR

This invention is in the field of clothing and in particular protecting areas of garments from soiling and wear with an adhesive patch which could incorporate an advertisement.

BACKGROUND

It is well known that certain areas of garments become soiled and wear more quickly than others, for example the knee area of pants and the elbow area of shirts, sweaters and like tops. Children's clothing is particularly susceptible to such soiling and wear because of the activities of the children.

Such areas often are the only area of a garment that is soiled, but the whole garment must be washed. Similarly these are often the only area that is worn, but the whole garment must be discarded. Protecting such areas from soiling and wear would be a great attraction to a child's care-giver.

It is known to provide certain areas with reinforcement with a different material, however these permanently change the garments appearance, and are soiled the same as the rest of the garment.

Companies are constantly seeking new ways to advertise their wares. It is highly desirable to take any opportunity to keep a company's name or logo before the public eye as much as possible. A company that could provide protection to a garment, such as a child's pants, would find that care-givers were quite willing and even enthusiastic about displaying the company's message to the public while providing the protection.

SUMMARY OF THE INVENTION

It is an object of the present invention to provide a method of protecting garments from soiling and wear, while at the same time allowing the garment to be restored to its original appearance if desired.

It is a further object of the present invention to provide such a method that also provided opportunities for advertisers to increase their exposure to the public.

It is a further object of the present invention to provide such a method wherein a removable and disposable adhesive patch is applied to the desired garment area, and wherein the adhesive patch could display an advertisers message.

The present invention provides in one aspect a method of protecting a garment area from soiling and wear, the method comprising adhesively attaching a flexible first adhesive patch to a desired garment area; removing and discarding the first adhesive patch and attaching a flexible second adhesive patch to substantially the same garment area.

Soiling and wear takes place on the patch, rather than on the garment. The patch can then be removed and discarded, and then replaced with a new patch.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE ILLUSTRATED EMBODIMENTS

Figure 1:
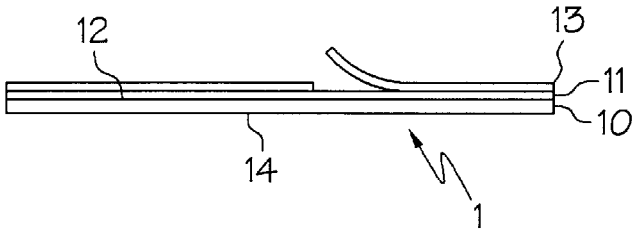
FIG. 1 is a schematic side view of an adhesive patch of the invention.
Figure 3:
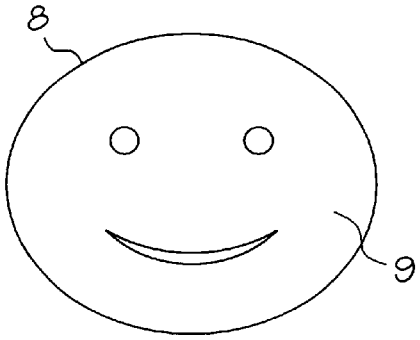
FIG. 3 shows an example of a design to decorate the adhesive patch.
Figure 2:
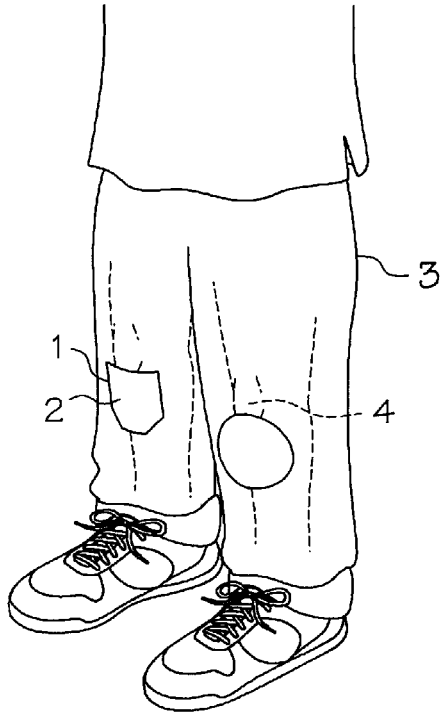
FIG. 2 is a front view of a pair of pants worn by a child and showing a suggested location of an adhesive patch of the invention.
Figure 4:
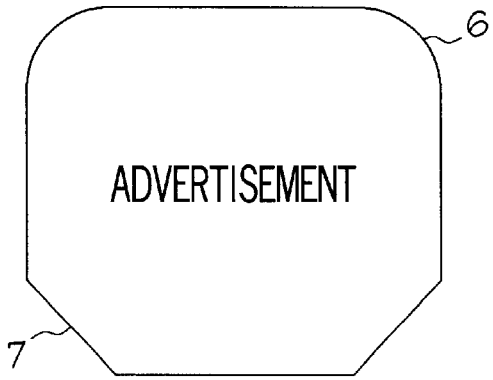
FIG. 4 shows that a n advertisement could be placed on an adhesive patch of the invention.

FIGS. 1–4 illustrate a method of protecting a garment from soiling and wear. The method comprises adhesively attaching a flexible first adhesive patch 1 to the desired garment area, illustrated as the knee area 2 of a pair of children's pants 3. Other areas of various garments, such as the seat or elbows could similarly be protected.

In order to provide satisfactory protection in the particular application illustrated, the adhesive patch 1 is adhesively attached to the pants 3 such that the adhesive patch 1 extends down from a lower portion of a child's knee 4 when the child is standing in the pants 3. In this way, when the child bends the knee 4 to kneel on the ground, the adhesive patch 1 rides up somewhat and is in the proper position to cover the area of the pants 3 that is between the knee 4 and the ground. Grass stains, dirt and the like, as well as friction and wear, takes place on the adhesive patch 1 rather than on the pants 3.

The adhesive patch 1 can simply be removed when soiled or worn, leaving the pants with their original appearance, and replaced immediately or later with a second adhesive patch 1 to cover substantially the same knee area.

The adhesive patch 1 can be provided with rounded or oblique corners 6, 7 or may be a generally oval or circular adhesive patch 8 with no corners to reduce the likelihood of the adhesive patch 1 peeling off the garment. Square or acute angles peel away from the garment more readily.

In order to enhance the desirability of the adhesive patches to a child wearing them, they may be decorated with a design desirable to children, such as the happy face 9 illustrated. Other designs or pictures that might be popular or trendy at any given time, such as dinosaurs, may be applied to the adhesive patch.

The adhesive patches of the invention could also provide an attractive advertising medium. An advertising design could be applied to the adhesive patch by a fast food or entertainment company or the like, and the adhesive patches could be sold for an inexpensive price, or given away as a promotion. Child care-givers would readily attach the adhesive patches to the child's clothing, in order to protect the clothing from soiling and wear. The child would be attracted by a pleasing design, which many advertisers are presently adept at providing. The adhesive patch then would serve as a mini-billboard, as well as a protective device for the garment.

As schematically illustrated in FIG. 1, the adhesive patch 1 comprises a thin plastic membrane 10, with an adhesive11applied to a back side 12 thereof. The adhesive11 is covered with a peel off cover 13. It is contemplated that other arrangements for adhesive attachment would also serve the purpose.

The outer surface 14 of the adhesive patch 1 is a smooth and impermeable surface adapted to facilitate wiping the outer surface 14 clean. Such surfaces are known in the art such as polyester plastic with a clear coat or varnish to protect the design. In some instances the surface 14 can be simply be wiped to remove stains, extending the life of the adhesive patch 1.

Children especially get their clothes dirty very quickly, in many cases requiring a change more than once a day. Often it is only a small area that is soiled, such as the knee area. With an adhesive patch of the invention, the care-giver can often simply wipe the adhesive patch clean, or remove it and apply a new adhesive patch in its place, rather than change and wash the garment.

The adhesive patches offer an advantageous advertising opportunity as well.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

I claim:

1. A method of protecting a garment area from soiling and wear, the garment area being visible when worn normally, the method comprising:

providing an adhesive covering substantially all of a back surface of flexible first and second adhesive patches;

providing a design or advertisement on an opposite outer surface of the flexible first and second adhesive patches;

releasably attaching the flexible first adhesive patch to a desired normally visible garment area;

removing and discarding the first adhesive patch and attaching the flexible second adhesive patch to substantially the same garment area.

2. The method of claim 1 wherein the first adhesive patch is removed when the first adhesive patch becomes soiled or worn.

3. The method of claim 1 wherein the first adhesive patch is removed when it is desired to restore the garment to its original appearance, and wherein the second adhesive patch is attached later to protect the garment from soiling and wear.

4. The method of claim 1 further comprising providing the adhesive patches with rounded or oblique corners to reduce the likelihood of the adhesive patches peeling off the garment.

5. The method of claim 1 further comprising providing generally oval or circular adhesive patches with no corners to reduce the likelihood of the adhesive patches peeling off the garment.

6. The method of claim 1 wherein the adhesive patches comprise a thin plastic membrane, with adhesive applied to a back side thereof, the adhesive covered with a peel off cover.

7. The method of claim 1 wherein the outer surface of the adhesive patches is adapted to facilitate wiping the surface clean.

8. The method of claim 7 wherein the outer surface is a smooth and impermeable surface.

9. The method of claim 1 wherein the garment is a pair of pants, and wherein the adhesive patches are adhesively attached to the pants such that the adhesive patches extend down from a lower portion of a child's knee when the child is standing in the pants.

10. The method of claim 9 wherein a top edge of the adhesive patches is attached to the pants at a lower portion of a child's knee when the child is standing in the pants.

* * * * *